US009745021B1

(12) United States Patent
Volakis

(10) Patent No.: US 9,745,021 B1
(45) Date of Patent: Aug. 29, 2017

(54) BOAT SHADE APPARATUS

(71) Applicant: Emanuel Dimitri Volakis, Napa, CA (US)

(72) Inventor: Emanuel Dimitri Volakis, Napa, CA (US)

( * ) Notice: Subject to any disclaimer, the term of this patent is extended or adjusted under 35 U.S.C. 154(b) by 0 days.

(21) Appl. No.: 14/948,162

(22) Filed: Nov. 20, 2015

Related U.S. Application Data

(60) Provisional application No. 62/083,854, filed on Nov. 24, 2014.

(51) Int. Cl.
*B63B 17/02* (2006.01)

(52) U.S. Cl.
CPC ..... *B63B 17/02* (2013.01)

(58) Field of Classification Search
CPC ..... E04H 15/06; B63B 17/02
USPC ..... 114/361
See application file for complete search history.

(56) References Cited

U.S. PATENT DOCUMENTS 5,096,257 A * 3/1992 Clark ..... A47C 7/66 135/96
6,968,800 B1 * 11/2005 Becht ..... B63B 17/00 114/361
7,243,990 B1 * 7/2007 Wahl ..... A47C 7/66 297/184.15
9,194,152 B1 * 11/2015 Plasencia ..... E04H 15/06
2011/0226297 A1 * 9/2011 Rewis ..... E04H 15/06 135/88.05

* cited by examiner

*Primary Examiner* — Anthony Wiest
(74) *Attorney, Agent, or Firm* — Zilka-Kotab, PC

(57) ABSTRACT

An apparatus is provided comprising a boat shade including an upper portion having a front end and a back end with an intermediate section therebetween. The boat shade further includes a lower portion having a top end coupled to the back end of the upper portion such that the lower portion extends downwardly from the upper portion. Further, the lower portion has a bottom end including a pair of members configured for being removably inserted into a pair of apertures of a boat.

20 Claims, 7 Drawing Sheets

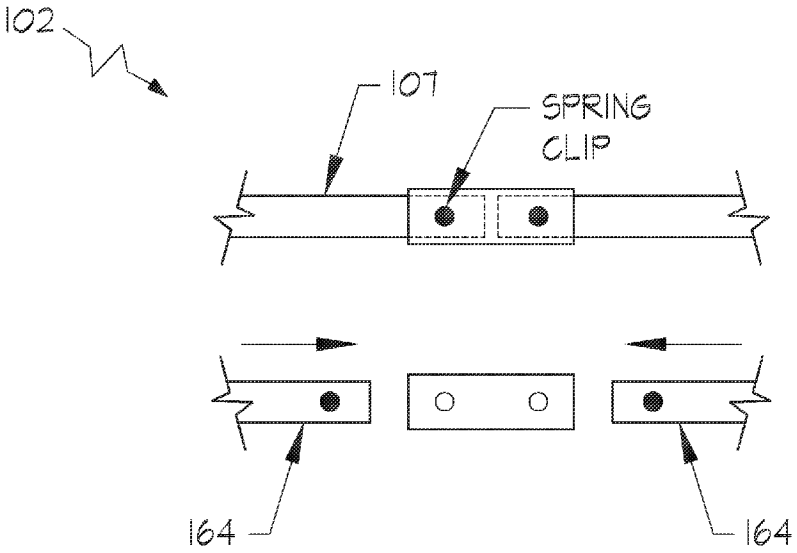
FIGURE 1-A

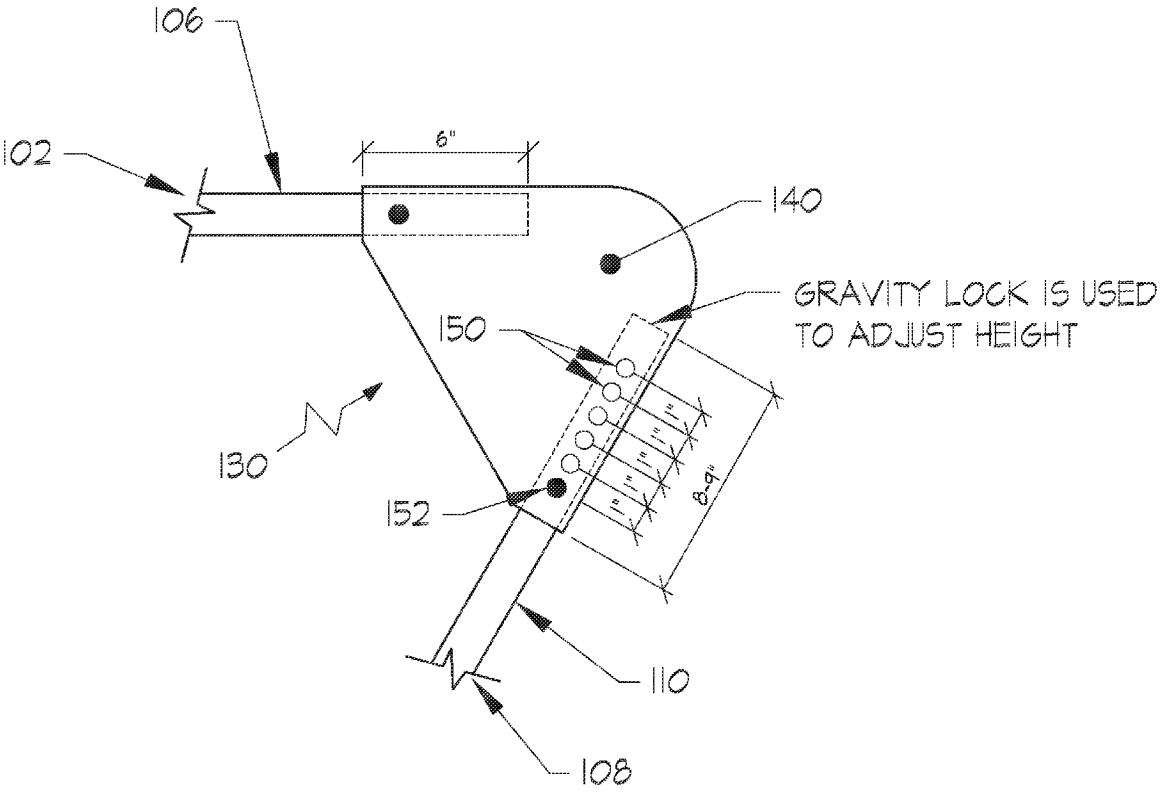
FIGURE 1-B

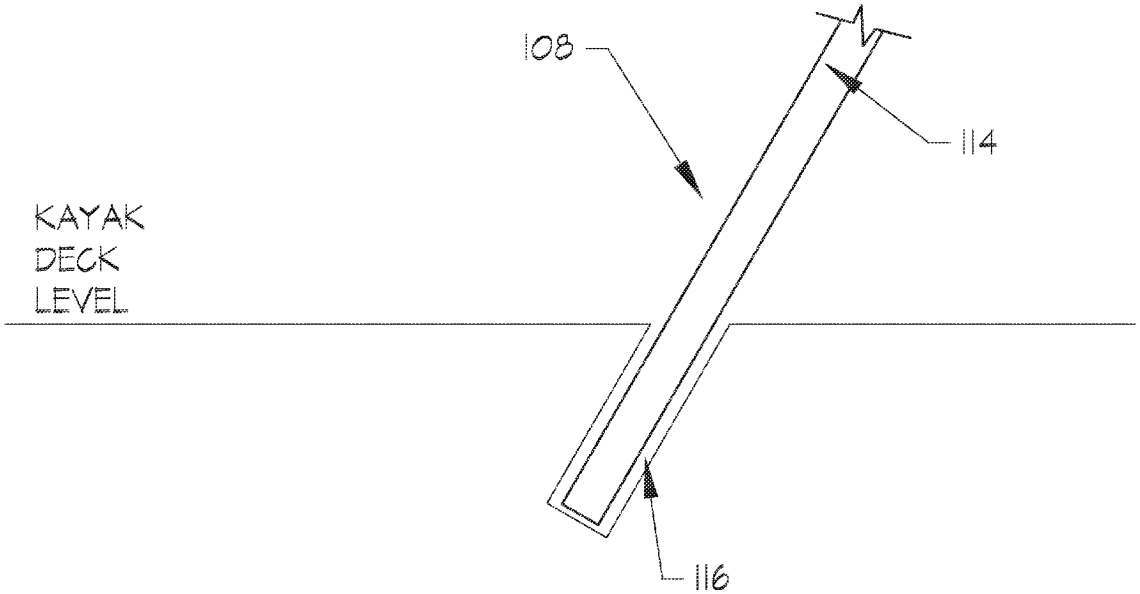
FIGURE 1-C

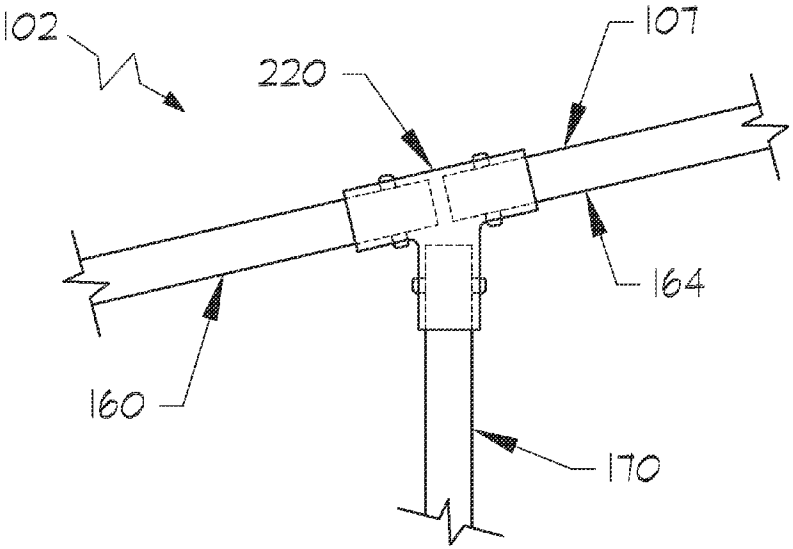
FIGURE 2-A

BOAT SHADE APPARATUS

RELATED APPLICATION(S)

This application claims priority to U.S. Application Ser. No. 62/083,854 filed Nov. 24, 2014, which is incorporated by reference in its entirety for all purposes.

FIELD OF THE INVENTION AND BACKGROUND

The present invention relates to boat shades, and more particularly to removable boat shades.

SUMMARY

An apparatus is provided comprising a boat shade including an upper portion having a front end and a back end with an intermediate section therebetween. The boat shade further includes a lower portion having a top end coupled to the back end of the upper portion such that the lower portion extends downwardly from the upper portion. Further, the lower portion has a bottom end including a pair of members configured for being removably inserted into a pair of apertures of a boat.

BRIEF DESCRIPTION OF THE DRAWINGS

FIG. 1-A is an enlarged side view of area 1-A of FIG. 1 showing removably-coupled rod sections, in accordance with one embodiment.

FIG. 1-B is an enlarged side view of area 1-B of FIG. 1 showing the coupling of the upper portion and the lower portion of the boat shade, in accordance with one embodiment.

FIG. 1-C is an enlarged side view of area 1-C of FIG. 1 showing the pair of members of the lower portion of the boat shade, in accordance with one embodiment.

FIG. 2-A is an enlarged top view of area 2-A of FIG. 2 showing the removably-coupled rod sections, in accordance with one embodiment.

DETAILED DESCRIPTION

Figure 1:
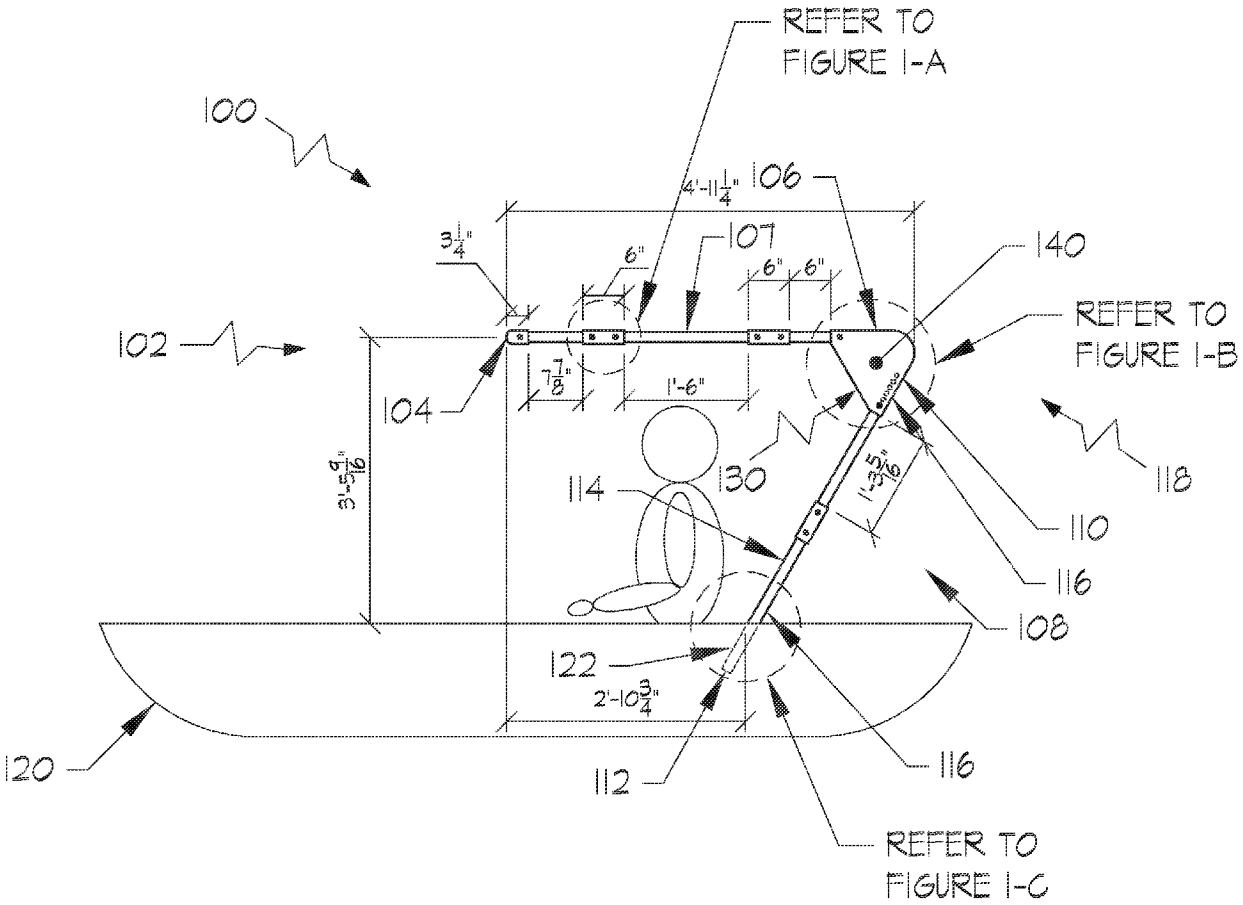
FIG. 1 illustrates a side view of a boat shade in use with a boat, in accordance with one embodiment.

FIG. 1 illustrates a side view of a boat shade in use with a boat, in accordance with one embodiment. As shown a boat shade 100 including an upper portion 102 having a front end 104 and a back end 106 with an intermediate section 107 therebetween.

The boat shade 100 further includes a lower portion 108 having a top end 110 coupled to the back end 106 of the upper portion 102 such that the lower portion 108 extends downwardly from the upper portion 102. Further, the lower portion 108 has a bottom end 112 including a pair of members 114 configured for being removably inserted into a pair of apertures 122 of a boat 120. The pair of apertures 122 may be manufactured with the boat 120 or may be inserted thereafter.

In one embodiment, the top end 110 of the lower portion 108 may be coupled to the back end 106 of the upper portion 102, in the manner shown. To this end, when the pair of members 114 are removably inserted into the pair of apertures 122 of the boat, the upper portion 102 may substantially reside in a horizontal plane. Of course, in other embodiments, when the pair of members 114 are removably inserted into the pair of apertures 122 of the boat, the upper portion may slant upwardly or downwardly, as desired, with respect to a horizontal plane.

In another embodiment, the top end 110 of the lower portion 108 is coupled to the back end 106 of the upper portion 102 such that the upper portion 102 resides in a first plane that forms an acute angle 130 with a second plane in which the lower portion 108 resides. Of course, in other embodiments, the top end 110 of the lower portion 108 may be coupled to the back end 106 of the upper portion 102 such that the upper portion 102 resides in a first plane that may form a right or obtuse angle with a second plane in which the lower portion 108 resides.

In one embodiment, a length of the lower portion 108 may range between 2-3 feet, while, in other embodiments, such length may range between 1-4, 2-4, 3-4, 1-3 feet, etc. Still yet, in one embodiment, a length of the upper portion 102 may range between 2-4 feet, while, in other embodiments, such length may range between 3-5, 4-5, 6-10, 7-10, 8-10, 8-9, 9-10 feet, etc. To this end, in one embodiment, the upper portion 102 may sit approximately 3-4 feet above a top of the boat 120, while, in other embodiments, such length may range between 2-5, 3-5, 4-5 feet, etc. thereabove.

In terms of proportions, a length of the lower portion 108 may be less than that of the upper portion 102 of the boat shade 100. For example, in different embodiments, a length of the lower portion 108 may be seventy-five (75%) that of the upper portion 102. Of course, in other embodiments, the 75% percentage may be replaced with 20%, 30%, 40%, 50%, 60%, 70%, 80%, 90%, or any range between any such percentages (or any other percentage, for that matter). In still other embodiments, the length of the lower portion 108 may be approximately equal (or within 5, 10, 15%, etc.) to that of the upper portion 102 of the boat shade 100.

With respect to a length of the boat 120, the upper portion 102 of the boat shade 100 may, in various embodiments, be approximately the same length as the length of the boat 120 or, in other embodiments (like the one shown), may be less than the length of the boat 120 [e.g. 90%, 80%, 70%, 60%, 50%, 40%, 30%, 20% thereof, or any range between any such percentages (or any other percentage, for that matter)].

FIG. 1-A is an enlarged side view of the area 1-A of FIG. 1 showing removably-coupled rod sections 164, in accordance with one embodiment. As shown, a spring clip may be used for effecting such removable coupling. In further embodiments, any type of spring loaded mechanism may be utilized, such as extension springs, torsion springs, or shocks springs. The spring clip or alternative spring loaded mechanism may be comprised of metal, plastic, or any other suitable material for effecting the removeable coupling. As shown in FIG. 1, a spring clip or other type of coupling mechanism may be used to couple each of the removably-coupled rod sections.

The removably-coupled rod sections 164 may be comprised of any material, such as PVC pipe, plastic, metal, or any other material. Further, the upper portion 102 and lower portion 108 may be comprised of different materials.

FIG. 1-B is an enlarged side view of the area 1-B of FIG. 1 showing the coupling of the upper portion 102 and the lower portion 108 of the boat shade 100, in accordance with one embodiment. As shown, the top end 110 of the lower portion 108 is fixedly, but yet adjustably coupled to the back end 106 of the upper portion 102. In one embodiment, a brace 140 may be included for bracing the aforementioned coupling. For example, such brace 140 may include a pair of triangular plates coupled to the upper portion 102 and lower portion 108, as shown (to be situated in parallel planes). Of course, in other embodiments, the aforementioned fixed coupling may be replaced with a pivotal (e.g. selectively pivoting, etc.) coupling to adjust an angle at which the upper portion 102 remains with respect to the lower portion 108.

The brace 140 may be comprised of metal, plastic, or any other rigid material. In another embodiment, the brace 140 may be comprised of a more flexible material, such as resin mesh. In yet a further embodiment, the brace 140 may include a spring loaded mechanism. Such spring loaded mechanism may increase flexibility and friction on the rod sections 164 discussed in FIG. 1-A.

As shown, the top end 110 of the lower portion 108 may be slidably inserted into a hollow sleeve formed in the brace 140, in the manner shown. Such slidable insertion may be further facilitated by gravity and the weight of the upper portion 102 of the shade 100. To lock the top end 110 of the lower portion 108 within the hollow sleeve formed in the brace 140, spring-loaded protrusions may extend from the top end 110 of the lower portion 108 for engaging one of a plurality of apertures 150 formed in the brace 140 along the hollow sleeve. In one embodiment, such apertures 150 may be spaced along the hollow sleeve every inch or so, to provide sufficient granularity in height adjustment of the upper portion 102 of the shade 100.

FIG. 1-C is an enlarged side view of the area 1-C of FIG. 1 showing the pair of members 114 of the lower portion 108 of the boat shade 100, in accordance with one embodiment. As shown, ends 116 of the pair of members 114 of the lower portion 108 may be removably positioned within a pair of bores (not numbered), in the manner shown. Such removable positioning may be facilitated via a frictional or other type of coupling.

While not shown, the ends 116 of the members 114 may, in another embodiment, include a pair of diametrically-opposed, spring-loaded protrusions for insertably engaging a sleeve (not shown). More information regarding such embodiment may be found with reference to U.S. Application Ser. No. 62/083,854 filed Nov. 24, 2014, which is incorporated by reference in its entirety for all purposes. In one embodiment, such structure may replace or supplement the protrusions 152 and apertures 154 formed in the brace 140, as shown in FIG. 1-B.

In any case, the aforementioned sleeve(s) may include one or more adjustment apertures. The spring loaded protrusions may engage one or more of the adjustment apertures in order to accommodate various heights of the ends 116 of the members 114 and thereby, in turn, adjust the overall height of the boat shade 100.

In one embodiment, the sleeve may be fixedly attached with respect to the boat 120. Further, the ends 116 of the members 114 may be moved up or down within the fixedly attached sleeve incrementally according to the adjustment apertures that are engaged.

In yet another embodiment, radially extending protrusions may frictionally engage inner walls of the pair of apertures of the boat 120. Of course, any desired coupling mechanism (e.g. integral, etc.) may be employed, in other embodiments.

In one embodiment, the ends 116 of the members 114 may extend into the pair of apertures by a measurement of approximately six inches. In alternative embodiments, the ends of the members extend into the apertures according to the aperture depth of the particular boat. For instance, the ends 116 of the members 114 may extend into the apertures seven to twelve inches. The radially-extending protrusions may include any type of spring loaded mechanism for adjusting the height of the overall boat shade 100. The spring loaded mechanism may include any type of material and/or spring discussed herein.

Figure 2:
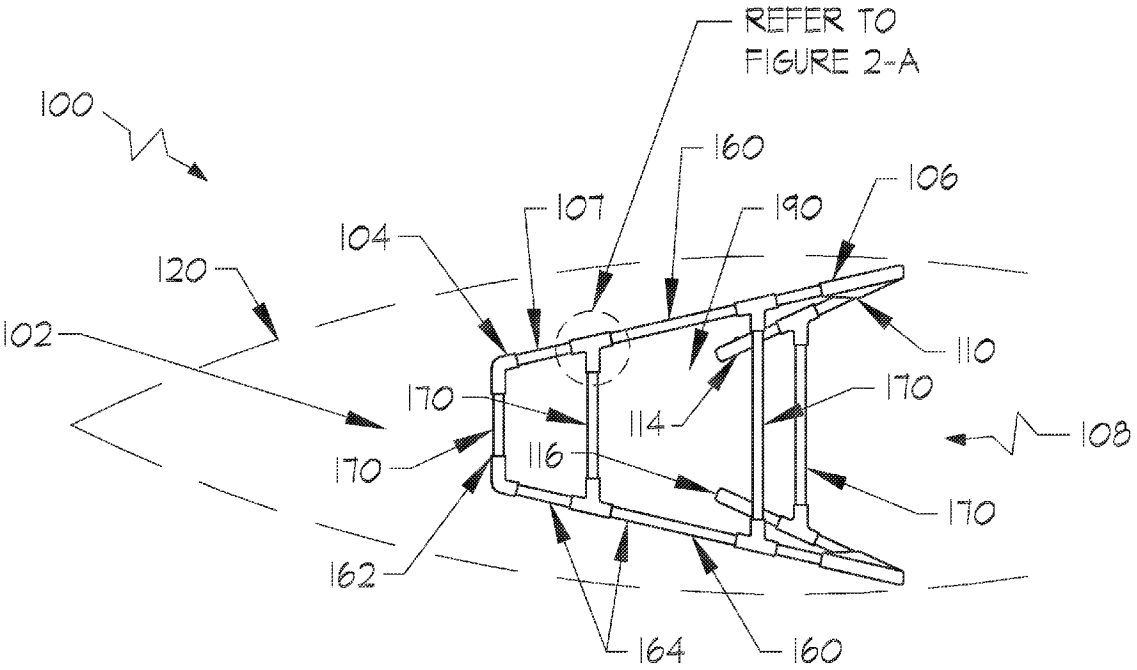
FIG. 2 shows a top view of the boat shade in use with the boat, in accordance with one embodiment.

FIG. 2 shows a top view of the boat shade in use with the boat, in accordance with one embodiment. As shown, a boat shade perimeter of the upper portion 102 and the lower portion 108 of the boat shade 100 are defined by a pair of elongated rods 160 having front ends that are fixedly coupled at point 162 and rear ends that include the members 114. As an option, the elongated rods 160 are formed of a plurality of separate removably coupled rod sections 164.

Further, the elongated rods 160 may extend outwardly away from each other as the elongated rods extend from the front end 104 of the upper portion 102 to the back end 106 of the upper portion 102. Still yet, the elongated rods 160 may extend inwardly toward each other as the elongated rods 160 extend from the top end 110 of the lower portion 108 to the bottom end 114 of the lower portion 108.

As an additional option, a plurality of cross bars 170 may extend between the elongated rods 160 defining the upper portion 102 and the lower portion 108 of the boat shade 100. In one embodiment, the plurality of cross bars 170 are removably coupled between the elongated rods 160. The plurality of cross bars 170 may include springs, such as the various springs discussed herein, for increasing the inward or outward pressure on the elongated rods 160.

In one embodiment, four of the cross bars 170 may be employed, a first one situated at a front end of the upper portion 102 (at point 162), a second one at a midpoint of the upper portion 102, a third one situated at a midpoint of the lower portion 108, and a fourth one situated proximate the coupling of the upper portion 102 and the lower portion 108 of the boat shade 102, where shown. Also as shown, the first one of the cross bars 170 may be a first length, the second one of the cross bars 170 may be a second length greater than the first length, the third one of the cross bars 170 may be a third length greater than the second length, and the fourth one of the cross bars 170 may be a fourth length greater than the third length, in accordance with one embodiment. Of course, such cross bars 170 may be of equal length (or similar length), in other embodiments.

As further shown, ends of the members 116 may extend along separate axes that intersect at an acute angle. Still yet, ends of the members 116 may extend downwardly and inwardly with respect to each other, in the manner illustrated. In other embodiments, such ends of the members 116 may extend along separate axes that remain parallel.

In use, a shade cover 190 is removably coupled between the elongated rods 160 along at least part of the upper portion 102 of the boat shade 100. In various embodiments, the material of such shade cover 190 may or may not be water permeable, light permeable, reflective, etc. To accomplish this, in one embodiment, the shade cover 190 may be comprised of Aluminet™. In other embodiments, the shade cover 190 is comprised of mesh solar shade or screen material. Of course, any type of material may be utilized for the shade cover 190, in various other embodiments.

The shade cover 190 may be coupled to the elongated rods 160 using grommets, cord, bolts, springs, or any other coupling mechanism. In one embodiment, the shade cover 190 may be coupled to the elongated rods 160 using plastic grommets and a para-cord under tension. In further embodiments, the shade cover 190 may be snapped or otherwise coupled around the elongated rods 160.

While any size is contemplated, the boat 120 may, in one embodiment, include a boat perimeter that is substantially proportional to a boat shade perimeter of the boat shade 100. In another possible embodiment, the boat shade perimeter may be smaller than (e.g. approximately half, etc.) the boat perimeter, as shown. In other embodiments, of course, the boat shade perimeter may extend beyond the boat perimeter.

For example, an area covered by the shade cover 190 may be 50% of an area defined by the boat perimeter. Of course, in different embodiments, such 50% figure may be replaced with 20%, 30%, 40%, 60%, 70%, 80%, or any range between any such percentages (or any other percentage, for that matter).

FIG. 2-A is an enlarged top view of the area 2-A of FIG. 2 showing the removably-coupled rod sections, in accordance with one embodiment. As illustrated, a pair of substantially T-shaped sleeves 220 are utilized to effect the coupling of the removably-coupled rod sections 164. As discussed herein with respect to various other embodiments, any type of spring may be utilized in addition to or instead of the substantially T-shaped sleeves 220. In other embodiments, any type of fastener may be utilized to couple the plurality of cross bars 170 to the elongated rods 160.

Figure 3:
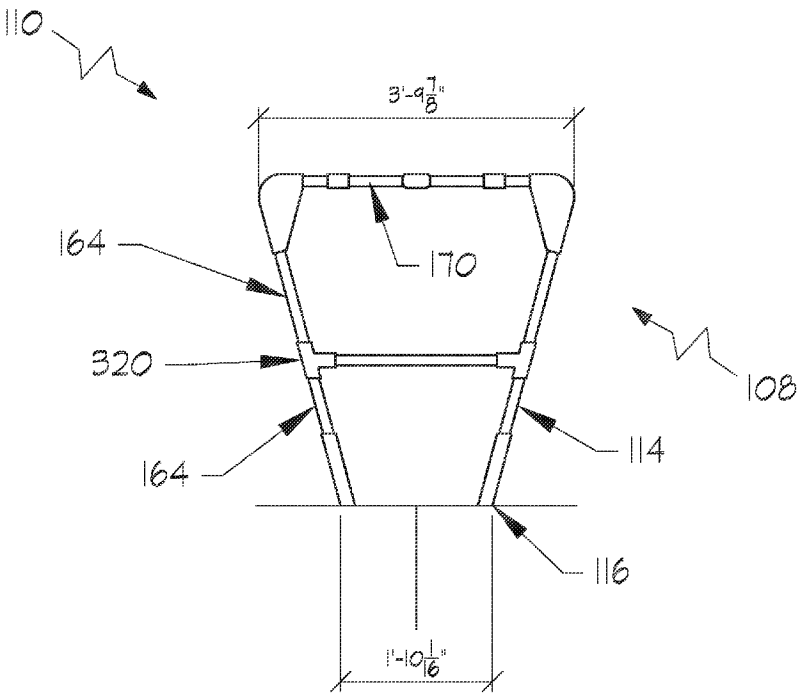
FIG. 3 shows a back view of the boat shade, in accordance with one embodiment.

FIG. 3 shows a back view of the boat shade, in accordance with one embodiment. As illustrated, a pair of substantially T-shaped sleeves 320 effect the coupling of the removably-coupled rod sections 164. The substantially T-shaped sleeves 320 may be comprised of any material, such as plastic or metal. Further, the substantially T-shaped sleeves 320 may include springs of any type, as discussed herein with respect to other embodiments. As discussed herein, any type of fastener may be utilized to couple the plurality of cross bars 170 to the elongated rods 160 and/or the removable-coupled rod sections 164 in other embodiments.

As mentioned during the description of FIG. 1-B, the aforementioned brace 140 may include a pair of triangular plates coupled to the upper portion 102 and lower portion 108, as shown (to be situated in parallel planes). As shown in FIG. 3, such brace 140 may also include a pair of triangular plates coupled to the upper portion 102 and lower portion 108, as shown (to be situated in the same plane). In one embodiment, the plates shown in FIG. 1-B and the present figure may be integrally coupled. Of course, as mentioned earlier, the aforementioned fixed coupling may be replaced with a pivotal (e.g. selectively pivoting, etc.) coupling to adjust an angle at which the upper portion 102 remains with respect to the lower portion 108.

While various embodiments have been described above, it should be understood that they have been presented by way of example only, and not limitation. Just by way of example, the measurements and/or dimensions included in the figures are included for illustrative purposes only and should not be construed as limiting in any manner. For example, tolerances on such measurements may range from 10%, 20%, 30%, 40% or more (and may not necessarily be proportional). Thus, the breadth and scope of a preferred embodiment should not be limited by any of the above-described exemplary embodiments, but should be defined only in accordance with the following claims and their equivalents.

What is claimed is:

1. An apparatus, comprising:

a boat shade including:

an upper portion of a first fixed length having a front end and a back end with an intermediate section therebetween, where sides of the upper portion are defined by a pair of elongated rods that extend outwardly away from each other from the front end of the upper portion to the back end of the upper portion;

a lower portion of a second fixed length that is less than the first fixed length having a top end and a bottom end, where sides of the lower portion are defined by a pair of elongated rods that extend inwardly toward each other from the top end of the lower portion to a bottom end of the lower portion;

the sides of the upper portion at the back end of the upper portion being coupled to the sides of the lower portion at the top end of the lower portion such that the lower portion extends downwardly from the upper portion;

the sides of the lower portion at the bottom end of the lower portion further including a pair of members configured for being removably inserted into a pair of apertures of a boat;

rod ends of the elongated rods defining the sides of the upper portion being fixedly positioned with respect to each other at the front end of the upper portion; and at least one fixed length cross bar coupled between the elongated rods defining the sides of the upper portion or lower portion.

2. The apparatus of claim 1, wherein the top end of the lower portion is coupled to the back end of the upper portion such that, when the pair of members are removably inserted into the pair of apertures of the boat, the upper portion substantially resides in a horizontal plane.

3. The apparatus of claim 1, wherein the top end of the lower portion is coupled to the back end of the upper portion such that the upper portion resides in a first plane that forms an acute angle with a second plane in which the lower portion resides.

4. The apparatus of claim 1, wherein the top end of the lower portion is moveably coupled to the back end of the upper portion.

5. The apparatus of claim 1, wherein ends of the members extend downwardly and inwardly with respect to each other.

6. The apparatus of claim 1, wherein ends of the members are sized for being frictionally inserted into the pair of apertures of the boat.

7. The apparatus of claim 1, wherein the members include a plurality of spring loaded protrusions.

8. The apparatus of claim 1, wherein the elongated rods defining the sides of the upper portion or lower portion are formed of a plurality of separate removably coupled rod sections.

9. The apparatus of claim 8, wherein the rod sections are coupled utilizing T-shaped sleeves.

10. The apparatus of claim 1, wherein a plurality of cross bars extend between the elongated rods defining the upper portion and the lower portion of the boat shade.

11. The apparatus of claim 10, wherein the plurality of cross bars are removably coupled between the elongated rods.

12. The apparatus of claim 1, and further comprising a shade cover removably coupled between the elongated rods defining the sides of the upper portion along at least part of the upper portion of the boat shade.

13. The apparatus of claim 12, wherein the shade cover is coupled to the boat shade utilizing grommets and a para-cord.

14. The apparatus of claim 12, wherein the shade cover is comprised of a reflective material.

15. The apparatus of claim 1, wherein ends of the members are configured to be removably inserted into the pair of apertures of the boat utilizing a spring clip.

16. The apparatus of claim 1, wherein the front end of the upper portion of the boat shade is uncoupled to the boat.

17. A system including the apparatus of claim 1, and further comprising the boat including a boat perimeter that is twice that of a boat shade perimeter of the boat shade.

18. The apparatus of claim 1, wherein the rod ends are fixedly positioned with respect to each other at the front end of the upper portion via a fixed coupling at the front end of the upper portion.

19. The apparatus of claim 1, wherein the rod ends are fixedly positioned with respect to each other at the front end of the upper portion via the at least one fixed length cross bar that is perpendicularly coupled at the front end of the upper portion.

20. The apparatus of claim 1, wherein the at least one fixed length cross bar is coupled between the elongated rods defining the sides of the upper portion.

* * * * *